US008920118B2

(12) United States Patent
Tsukamoto et al.

(10) Patent No.: US 8,920,118 B2
(45) Date of Patent: Dec. 30, 2014

(54) CASING STRUCTURE

(75) Inventors: Minoru Tsukamoto, Yokohama (JP); Nobusada Takahara, Kamiina-gun (JP); Kazuaki Kurihara, Yokohama (JP)

(73) Assignee: IHI Corporation (JP)

( * ) Notice: Subject to any disclaimer, the term of this patent is extended or adjusted under 35 U.S.C. 154(b) by 657 days.

(21) Appl. No.: 13/074,298

(22) Filed: Mar. 29, 2011

(65) Prior Publication Data

US 2011/0236202 A1 Sep. 29, 2011

(30) Foreign Application Priority Data

Mar. 29, 2010 (JP) ..... P2010-074928

(51) Int. Cl.

| | |
|---|---|
| ***F01D 25/24*** | (2006.01) |
| ***F04D 29/40*** | (2006.01) |
| ***F04D 29/42*** | (2006.01) |
| ***F04D 29/08*** | (2006.01) |
| ***F04D 29/62*** | (2006.01) |

(52) U.S. Cl.

CPC ..... *F04D 29/4206* (2013.01); *F04D 29/083* (2013.01); *F04D 29/624* (2013.01)

USPC ..... 415/214.1

(58) Field of Classification Search

CPC ..... F01D 25/243; F01D 25/26; F01D 25/24; F01D 25/246; F01D 25/265; F04D 29/083; F04D 29/624; F04D 29/4206; F04D 29/426

USPC ..... 415/214.1, 215.1, 225; 277/628, 637, 277/608–608, 616

See application file for complete search history.

(56) References Cited

U.S. PATENT DOCUMENTS

| | | | | |
|---|---|---|---|---|
| 3,922,117 | A * | 11/1975 | Weatherston | 418/9 |
| 7,182,574 | B2 * | 2/2007 | Lyons | 415/213.1 |
| 2009/0193840 | A1 | 8/2009 | Kurihara et al. | 62/468 |
| 2009/0193842 | A1 | 8/2009 | Tsukamoto et al. | 62/498 |
| 2009/0193845 | A1 | 8/2009 | Sugitani | 62/510 |

FOREIGN PATENT DOCUMENTS

| | | |
|---|---|---|
| JP | 2910472 | 6/1999 |
| JP | 2009-2277 | 1/2009 |

OTHER PUBLICATIONS

Office Action dated Feb. 6, 2013 issued in corresponding Chinese Patent Application No. 201110076509.0 with English translation.

* cited by examiner

*Primary Examiner* — Edward Look
*Assistant Examiner* — Christopher J Hargitt
(74) *Attorney, Agent, or Firm* — Ostrolenk Faber LLP

(57) ABSTRACT

Provided is a casing structure including: an annular seal member which is disposed at a connection portion between first and second casings to keep air-tightness between an internal space formed by connecting the first and second casings to each other and an outside of the internal space; a first screw member which is threaded from the internal space, is disposed at the inside of the seal member in the radial direction, and fastens the first and second casings to each other; and a second screw member which is threaded from the outside, is disposed at the outside of the seal member in the radial direction, and fastens the first and second casings to each other.

11 Claims, 4 Drawing Sheets

CASING STRUCTURE

BACKGROUND OF THE INVENTION

1. Field of the Invention

The present invention relates to a casing structure. Priority is claimed on Japanese Patent Application No. 2010-074928, filed Mar. 29, 2010, the content of which is incorporated herein by reference.

2. Background Art

A turbo compressor compressing a gas such as air or a refrigerant gas through the rotation of an impeller and discharging the compressed gas is known. The turbo compressor includes, for example, a motor generating rotation power, an impeller rotated by the rotation power of the motor transmitted thereto, and a pair of gears transmitting the rotation power of the motor to the impeller (for example, refer to Japanese Patent No. 2910472). The motor is disposed inside a motor casing, and the impeller and the pair of gears are both disposed inside one compressor casing. An annular seal member is disposed at the connection portion between the motor casing and the compressor casing so as to keep the air-tightness thereof.

However, since the above-described compressor casing is provided to surround both the impeller and the pair of gears, the shape of the compressor casing is apt be complicated and the external shape thereof is apt to increase in size. Since the process of manufacturing the compressor casing becomes complicated, manufacturing effort and cost increase. For this reason, instead of the compressor casing, a casing structure may be used which connects an impeller casing (a first casing) surrounding an impeller and a gear casing (a second casing) accommodating a pair of gears. Furthermore, in order to keep the air-tightness of the connection portion between the impeller casing and the gear casing, the annular seal member is also disposed in the connection portion. Further, a plurality of screw members (bolts and the like) is used to connect the impeller casing and the gear casing to each other. When using the screw member, a part of the screw member is threaded into an internal space formed by connecting the impeller casing and the gear casing to each other in order to decrease the size of the casing as much as possible.

However, the screw member is disposed at the outside of the seal member in the radial direction due to the general arrangement relationship between the seal member and the screw member in the connection portion. For this reason, there is a concern that a gas inside the internal space (a gas flowing from the impeller) may flow to the outside or a gas may flow from the outside into the internal space through a penetration hole into which the screw member at the internal space side is inserted.

The invention is made in view of such circumstances, and an object thereof is to provide a casing structure capable of preventing an inflow and an outflow of a gas in a connection portion between a first casing and a second casing even when a part of a screw member connecting the first casing and the second casing to each other is threaded from an internal space formed by connecting the casings to each other.

SUMMARY OF THE INVENTION

In order to solve the above-described problems, the invention adopts the following configurations.

(1) A casing structure of the invention includes an annular seal member which is disposed at a connection portion between first and second casings to keep air-tightness between an internal space formed by connecting the first and second casings to each other and an outside of the internal space. Further, the casing structure includes a first screw member which is threaded from the internal space, is disposed at the inside of the seal member in the radial direction, and fastens the first and second casings to each other; and a second screw member which is threaded from the outside, is disposed at the outside of the seal member in the radial direction, and fastens the first and second casings to each other.

According to the above-described casing structure, the first screw member is threaded from the internal space, and the penetration hole formed in one of the first casing and the second casing and allowing the first screw member to be inserted therethrough communicates with the internal space. For this reason, there is a concern that a gas inside the internal space may flow to the outside or an external gas may flow into the internal space through the penetration hole. However, since the first screw member is disposed at the inside of the annular seal member in the radial direction, the seal member prevents the inflow or the outflow of the gas through the penetration hole.

(2) The first and second casings may be provided to surround two predetermined axes, and the two axes may be disposed to be eccentric with respect to each other.

(3) The seal member may be disposed in an annular shape in the connection portion.

According to the aspect of the invention, it is possible to prevent the inflow and the outflow of the gas in the connection portion between the first casing and the second casing even when a part of the screw member as the first screw member connecting the first casing and the second casing to each other is threaded from the internal space formed by connecting the casings to each other.

DETAILED DESCRIPTION OF THE INVENTION

Hereinafter, an exemplary embodiment of the invention will be described by referring to FIGS. 1 to 4. In the respective drawings used for the following description, the scales of the respective members are appropriately changed so that the respective members have recognizable sizes.

Figure 1:
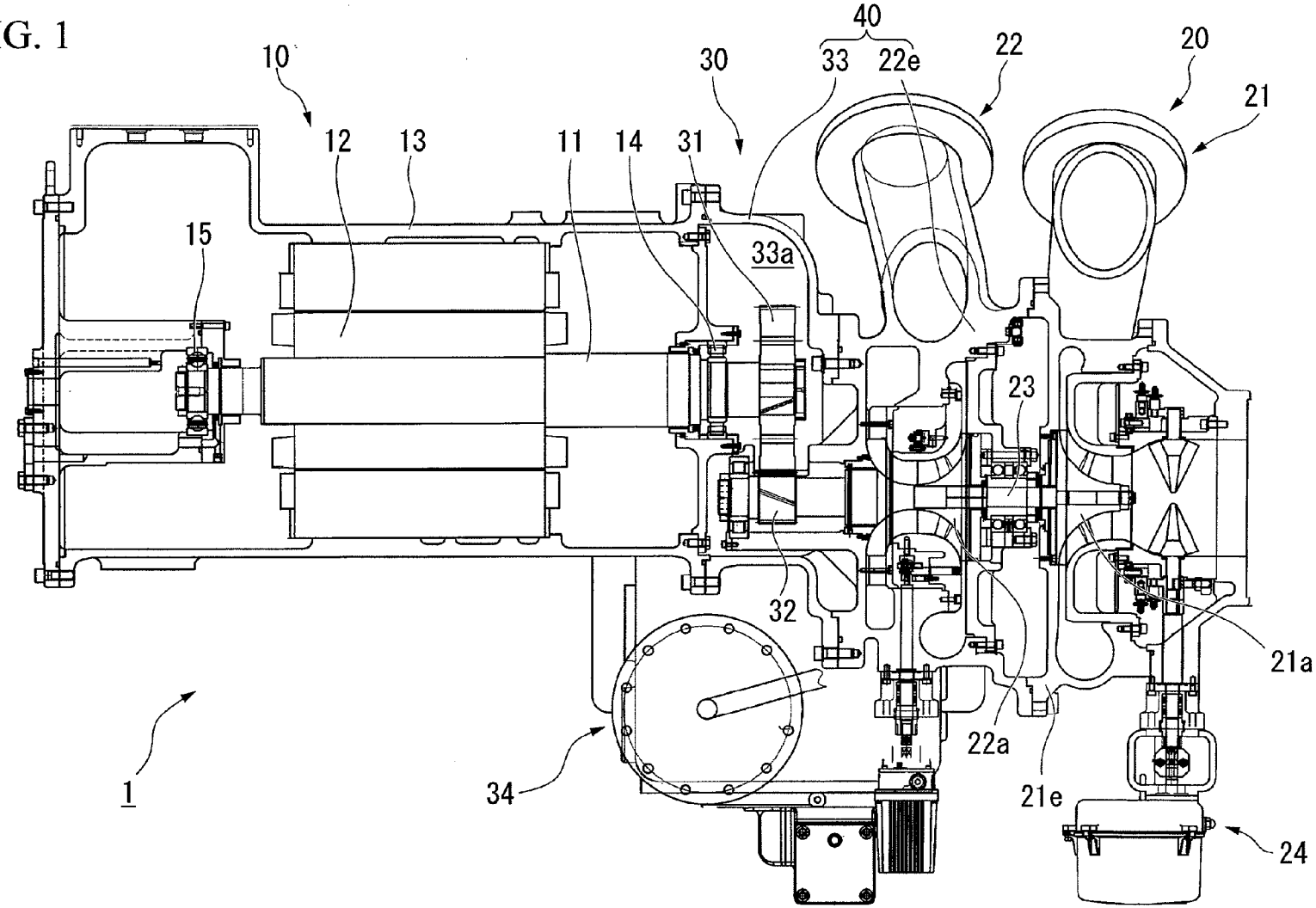
FIG. 1 is a horizontal cross-sectional view illustrating a turbo compressor of an embodiment of the present invention.
Figure 2:
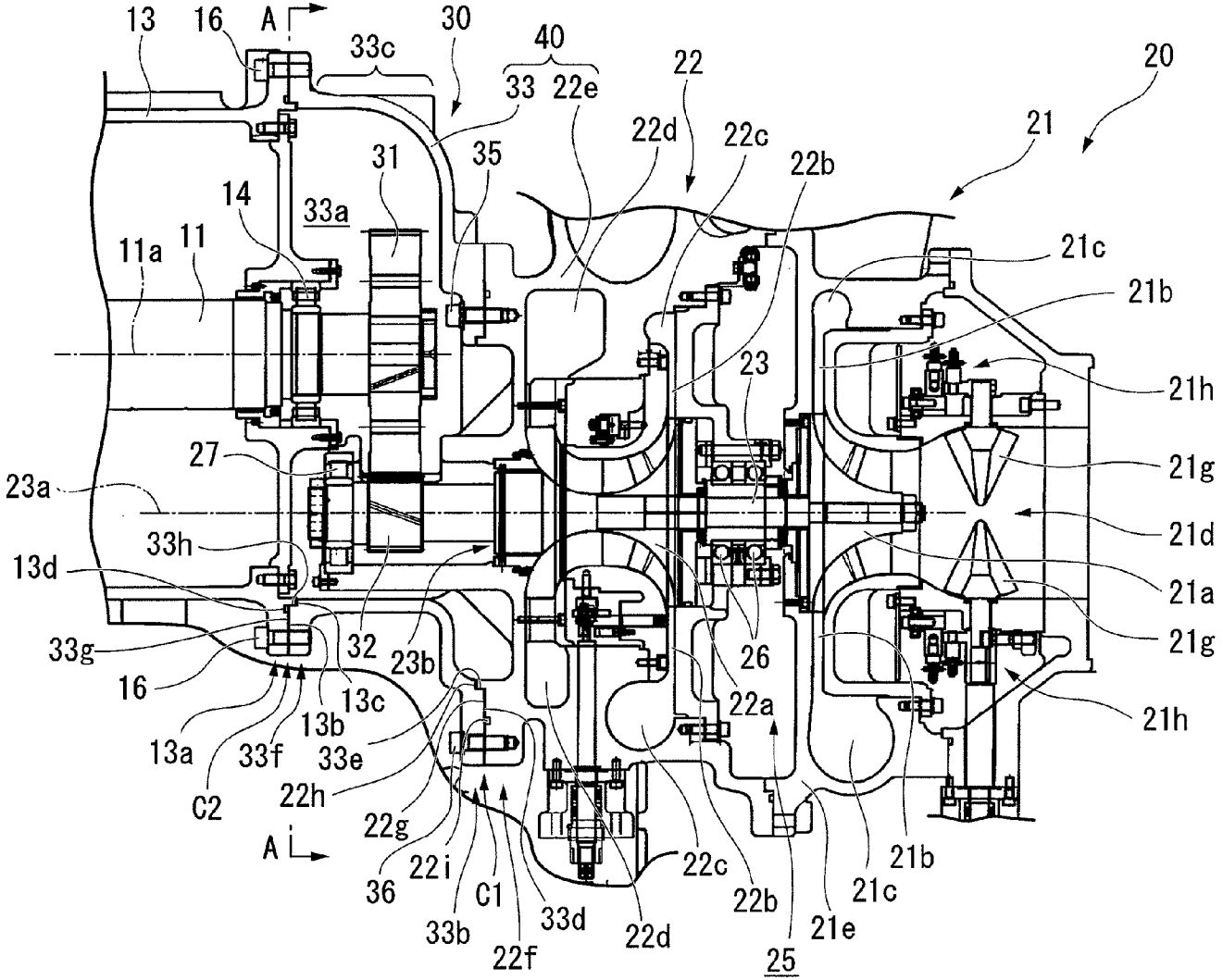
FIG. 2 is an enlarged horizontal cross-sectional view illustrating a compressor unit and a gear unit included in the turbo compressor of the embodiment of the present invention.
Figure 3:
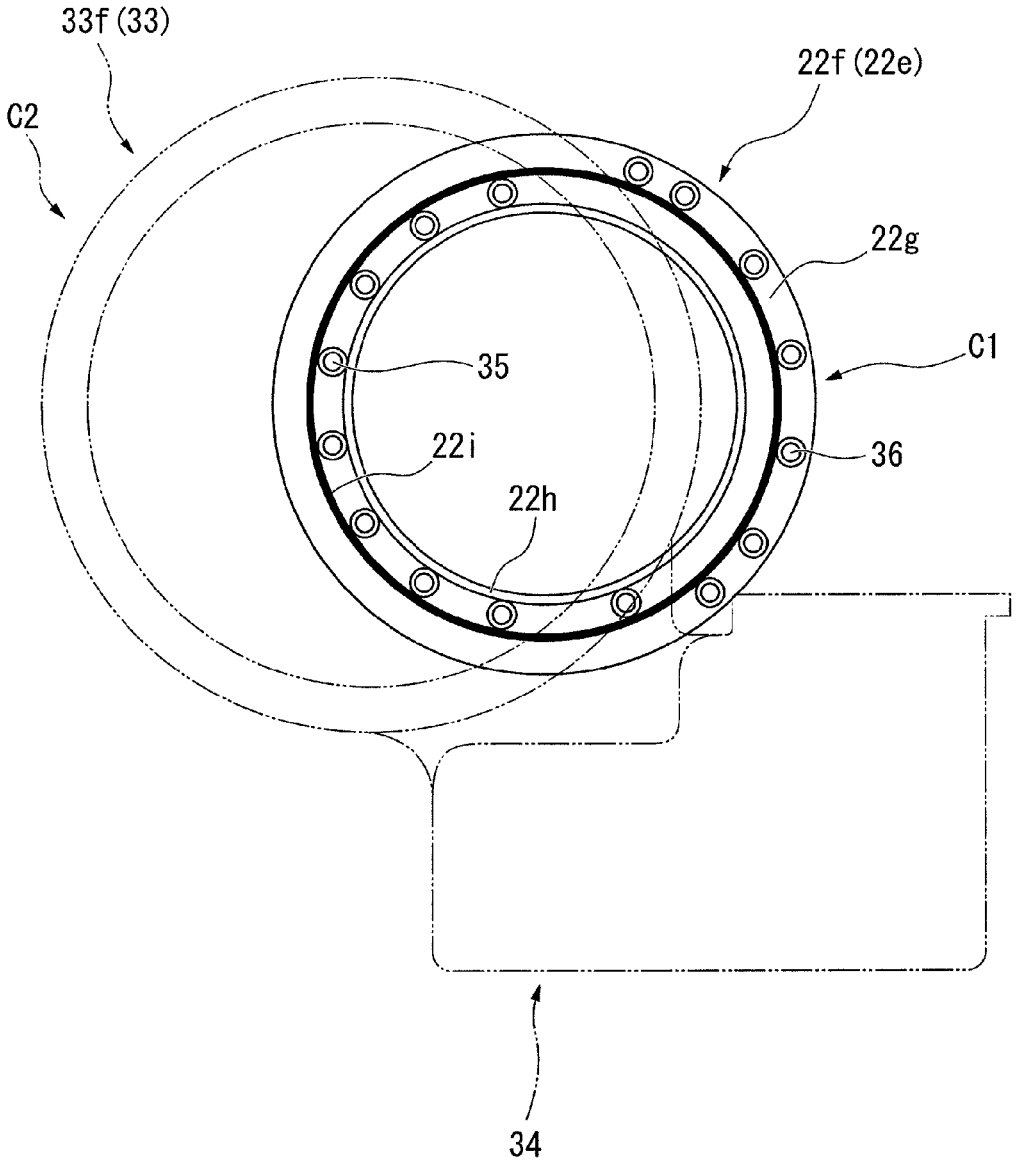
FIG. 3 is a cross-sectional view taken along the line A-A of FIG. 2.

FIG. 1 is a horizontal cross-sectional view of a turbo compressor 1 of the embodiment. FIG. 2 is an enlarged horizontal cross-sectional view illustrating a compressor unit 20 and a gear unit 30 included in the turbo compressor 1. FIG. 3 is a cross-sectional view taken along the line A-A of FIG. 2. Furthermore, in FIG. 3, only a first frame portion **22*f* in a second impeller casing 22*e* is shown, and a gear casing 33** is depicted by an imaginary line.

The turbo compressor 1 of the embodiment is used in a turbo refrigerator (not shown) installed in a building, a factory, or the like to generate an air-conditioning cooling water, and is configured to compress a refrigerant gas introduced from an evaporator (not shown) of the turbo refrigerator and discharge the compressed refrigerant gas. As shown in FIG. 1, the turbo compressor 1 includes a motor unit 10, a compressor unit 20, and a gear unit 30.

The motor unit 10 includes a motor 12 which includes an output shaft 11 and serves as a drive source driving the compressor unit 20, and a motor casing 13 which surrounds the motor 12 and in which the motor 12 is installed. The drive unit driving the compressor unit 20 is not limited to the motor 12. For example, an internal combustion engine may be used. The output shaft 11 of the motor 12 is rotatably supported by a first bearing 14 and a second bearing 15 fixed to the motor casing 13.

The compressor unit 20 includes a first compression stage 21 which suctions and compresses the refrigerant gas, and a second compression stage 22 which further compresses the refrigerant gas compressed at the first compression stage 21 and discharges the refrigerant gas as the compressed refrigerant gas.

As shown in FIG. 2, the first compression stage 21 includes a first impeller 21*a* which applies velocity energy to the refrigerant gas supplied in the thrust direction and discharges the refrigerant gas in the radial direction, a first diffuser 21*b* which compresses the refrigerant gas by converting velocity energy applied from the first impeller 21*a* to the refrigerant gas into pressure energy, a first scroll chamber 21*c* which guides the refrigerant gas compressed by the first diffuser 21*b* to the outside of the first compression stage 21, and a suction port 21*d* which suctions the refrigerant gas and supplies the refrigerant gas to the first impeller 21*a*. Furthermore, a part of the first diffuser 21*b*, the first scroll chamber 21*c*, and the suction port 21*d* is formed by the first impeller casing 21*e* surrounding the first impeller 21*a*.

A rotation shaft 23 is provided inside the compressor unit 20 so as to extend across the first compression stage 21 and the second compression stage 22. The first impeller 21*a* is fixed to the rotation shaft 23, and the rotation shaft 23 is rotated by rotation power transmitted from the output shaft 11 of the motor 12 (not shown in FIG. 2). Further, a plurality of inlet guide vanes 21*g* for adjusting the suction capacity of the first compression stage 21 is installed in the suction port 21*d* of the first compression stage 21. Each inlet guide vane 21*g* is rotatably supported by a drive mechanism 21*h* fixed to the first impeller casing 21*e* so that an area when seen from the upstream in the stream direction of the refrigerant gas is changeable. Further, a vane drive unit 24 (refer to FIG. 1) is installed at the outside of the first impeller casing 21*e* so that the vane drive unit is connected to the drive mechanism 21*h* and rotates each inlet guide vane 21*g*.

The second compression stage 22 includes a second impeller 22*a* which discharges the refrigerant gas in the radial direction by applying velocity energy to the refrigerant gas compressed at the first compression stage 21 and supplied in the thrust direction, a second diffuser 22*b* which compresses and discharges the compressed refrigerant gas by converting the velocity energy applied to the refrigerant gas into pressure energy by the second impeller 22*a*, a second scroll chamber 22*c* which derives the compressed refrigerant gas discharged from the second diffuser 22*b* to the outside of the second compression stage 22, and an introduction scroll chamber 22*d* which guides the refrigerant gas compressed by the first compression stage 21 to the second impeller 22*a*. Furthermore, the second diffuser 22*b*, the second scroll chamber 22*c*, and the introduction scroll chamber 22*d* are formed by the second impeller casing (the first casing) 22*e* surrounding the axis 23*a* of the rotation shaft 23 and accommodating the second impeller 22*a*.

The second impeller 22*a* is fixed to the rotation shaft 23 so that the rear surface thereof is fixed to the rear surface of the first impeller 21*a*, and is rotated by rotation power transmitted from the output shaft 11 of the motor 12 to the rotation shaft 23.

Furthermore, the first scroll chamber 21*c* of the first compression stage 21 and the introduction scroll chamber 22*d* of the second compression stage 22 are connected to each other through an external pipe (not shown) provided separately from the first compression stage 21 and the second compression stage 22, and the refrigerant gas compressed at the first compression stage 21 is supplied to the second compression stage 22 through the external pipe.

Further, the rotation shaft 23 is rotatably supported by a third bearing 26 fixed to the second impeller casing 22*e* of the second compression stage 22 and a fourth bearing 27 fixed to the second impeller casing 22*e* at the side of the gear unit 30 in a space 25 between the first compression stage 21 and the second compression stage 22. The rotation shaft 23 is provided with a labyrinth seal 23*b* which suppresses the refrigerant gas from flowing from the introduction scroll chamber 22*d* toward the gear unit 30.

The gear unit 30 is used to transmit rotation power of the motor 12 from the output shaft 11 to the rotation shaft 23. The gear unit 30 includes a large-diameter gear 31 which is fixed to the output shaft 11 of the motor 12, a small-diameter gear 32 which is fixed to the rotation shaft 23 and meshing with the large-diameter gear 31, and a gear casing (a second casing) 33 which accommodates the large-diameter gear 31 and the small-diameter gear 32.

The large-diameter gear 31 has an outer diameter larger than that of the small-diameter gear 32, and the rotation power of the motor 12 is transmitted to the rotation shaft 23 by the cooperation of the large-diameter gear 31 and the small-diameter gear 32 so that the rpm of the rotation shaft 23 increases with respect the rpm of the output shaft 11. Furthermore, the method of transmitting the rotation power of the motor 12 is not limited to the above-described transmission method. For example, the diameters of the plurality of gears may be set so that the rpm of the rotation shaft 23 becomes equal to or lower than the rpm of the output shaft 11. In order to ensure the smooth rotation of the large-diameter gear 31 and the small-diameter gear 32 meshing with each other, the gap between the large-diameter gear 31 and the small-diameter gear 32 is set to an appropriate value. Since the large-diameter gear 31 is fixed to the output shaft 11 and the small-diameter gear 32 is fixed to the rotation shaft 23, the axis 23*a* of the rotation shaft 23 is eccentrically spaced from the axis 11*a* of the output shaft 11 by a predetermined distance.

The gear casing 33 accommodates the large-diameter gear 31 and the small-diameter gear 32, is molded separately from the motor casing 13 and the second impeller casing 22*e*, and connects them to each other. The gear casing 33 is provided to surround the axis 11 a of the output shaft 11. Further, the gear casing 33 is connected with an oil tank 34 (refer to FIG. 1) collecting and storing the lubricant supplied to the sliding position of the turbo compressor 1. Furthermore, the gear casing 33 is connected to the second impeller casing 22*e* at the first connection portion (the connection portion) C1 and is connected to the motor casing 13 at the second connection portion C2.

The casing structure 40 as a characteristic point of the embodiment is formed by the second impeller casing 22*e* and the gear casing 33 connected to each other at the first connection portion C1. The interior of the casing structure 40 is provided with an accommodation space (an internal space) 33*a* accommodating the large-diameter gear 31 and the small-diameter gear 32. The accommodation space 33*a* is formed by connecting the second impeller casing 22*e* and the gear casing 33 to each other. Furthermore, the accommodation space 33*a* of the embodiment becomes a closed space by connecting the motor casing 13 and the gear casing 33 to each other.

The second impeller casing 22*e* is provided with the annular first frame portion 22*f* connected to the gear casing 33 at the first connection portion C1. On the other hand, the gear casing 33 is provided with an annular second frame portion 33*b* connected to the first frame portion 22*f* of the second impeller casing 22*e* at the first connection portion C1. Furthermore, since the axis 23*a* of the rotation shaft 23 is eccentric with respect to the axis 11*a* of the output shaft 11, the second frame portion 33*b* is provided at a position displaced from a body portion 33*c* provided around the axis 11*a* of the gear casing 33 toward the rotation shaft 23.

The first frame portion 22*f* includes an annular first contact surface 22*g* formed in a planar shape facing the second frame portion 33*b* and a first convex portion 22*h* formed throughout the entire inner periphery of the first contact surface 22*g* in the radial direction and protruding toward the second frame portion 33*b*. The second frame portion 33*b* includes a second contact surface 33*d* formed in a planar shape parallel to the first contact surface 22*g* and coming into contact with the first contact surface 22*g* and a first concave portion 33*e* formed throughout the entire inner periphery of the second contact surface 33*d* in the radial direction and closely fitted to the first convex portion 22*h* (or having a minute gap of an allowable range in consideration of precision).

An annular first seal member (a seal member) 22*i* for keeping the air-tightness of the first connection portion C1 is provided between the first contact surface 22*g* and the second contact surface 33*d*. The first seal member 22*i* is disposed inside an annular groove portion (not shown) formed in the first contact surface 22*g*.

Further, in the first connection portion C1, a plurality of first bolts (first screw members) 35 threaded from the accommodation space 33*a* and fastening the first frame portion 22*f* and the second frame portion 33*b* to each other and a plurality of second bolts (second screw members) 36 threaded from the outside of the gear casing 33 and fastening the first frame portion 22*f* and the second frame portion 33*b* to each other are used. Furthermore, the second bolts 36 may be threaded from the outside of the second impeller casing 22*e*.

As shown in FIG. 3, the plurality of first bolts 35 are disposed at the inside of the first seal member 22*i* in the radial direction, and the plurality of second bolts 36 are disposed at the outside of the first seal member 22*i* in the radial direction. That is, since each of the first bolts 35 is threaded from the accommodation space 33*a*, it is not necessary to provide a predetermined flange and the like for the attachment of the bolt (the screw member) threaded from the outside of the turbo compressor 1 in each of the second impeller casing 22*e* and the gear casing 33 to the outside thereof. Accordingly, each casing can be decreased in size. Further, since the threading direction of the first bolt 35 is equal to that of the second bolt 36, the first bolt 35 and the second bolt 36 can be simultaneously threaded from one side, so that the workability improves.

As shown in FIG. 2, the motor casing 13 is provided with an annular first flange portion 13*a* connected to the gear casing 33 at the second connection portion C2. On the other hand, the gear casing 33 is provided with an annular second flange portion 33*f* connected to the first flange portion 13*a* of the motor casing 13 at the second connection portion C2.

The first flange portion 13*a* includes an annular third contact surface 13*b* formed in a planar shape facing the second flange portion 33*f* and a second convex portion 13*c* formed throughout the entire inner periphery of the third contact surface 13*b* in the radial direction and protruding toward the second flange portion 33*f*. The second flange portion 33*f* includes a fourth contact surface 33*g* formed in a planar shape parallel to the third contact surface 13*b* and coming into contact with the third contact surface 13*b* and a second concave portion 33*h* formed throughout the entire inner periphery of the fourth contact surface 33*g* in the radial direction and closely fitted to the second convex portion 13*c* (or having a minute gap of an allowable range in consideration of precision).

An annular second seal member 13*d* for keeping the air-tightness of the second connection portion C2 is provided between the third contact surface 13*b* and the fourth contact surface 33*g*. The second seal member 13*d* is disposed in the annular groove portion (not shown) formed in the third contact surface 13*b*. Further, in the second connection portion C2, a plurality of third bolts 16 threaded from the outside of the motor casing 13 and fastening the first flange portion 13*a* and the second flange portion 33*f* to each other is used. The plurality of third bolts 16 is disposed at the outside of the second seal member 13*d* in the radial direction.

The first convex portion 22*h* is fitted to the first concave portion 33*e* at the first connection portion C1, and the second convex portion 13*c* is fitted to the second concave portion 33*h* at the second connection portion C2. Accordingly, each of the second impeller casing 22*e* and the motor casing 13 is positioned with respect to the gear casing 33. As a result of the positioning operation, the gap between the output shaft 11 and the rotation shaft 23, that is, the gap between the large-diameter gear 31 and the small-diameter gear 32 is set to an appropriate value capable of ensuring a smooth rotation.

In order to set the gap between the large-diameter gear 31 and the small-diameter gear 32 to an appropriate value, it is necessary to appropriately set the relative positions of the first concave portion 33*e* and the second concave portion 33*h* in the gear casing 33. Since the gear casing 33 is molded by casting (sand mold casing, metal mold casting, or the like), it is difficult to precisely mold the second frame portion 33*b* and the second flange portion 33*f*. For this reason, the portions formed by casting are molded by machining (cutting, grinding, or the like).

Furthermore, since the second impeller casing 22*e* is molded by casting, the groove portion provided with the first contact surface 22*g*, the first convex portion 22*h*, and the first seal member 22*i* in the first frame portion 22*f* are all molded by machining. Here, since the groove portion provided with the first seal member 22*i* is formed in an annular shape, the groove portion may be simply processed at low cost compared to a groove portion having a polygonal shape or a groove portion formed by connecting circular arcs having different diameters to each other.

Next, an operation of the turbo compressor 1 of the embodiment will be described.

First, the rotation power of the motor 12 is transmitted to the rotation shaft 23 through the large-diameter gear 31 and the small-diameter gear 32. Accordingly, the first impeller 21*a* and the second impeller 22*a* of the compressor unit 20 are rotated.

When the first impeller 21*a* is rotated, the suction port 21*d* of the first compression stage 21 enters a negative state, and the refrigerant gas flows into the first compression stage 21 through the suction port 21*d*. The refrigerant gas flowing into the first compression stage 21 flows into the first impeller 21*a* in the thrust direction, and is discharged in the radial direction by applying velocity energy thereto by the first impeller 21*a*. The refrigerant gas discharged from the first impeller 21*a* is compressed by converting velocity energy into pressure energy by the first diffuser 21*b*. The refrigerant gas discharged from the first diffuser 21*b* is guided to the outside of the first compression stage 21 through the first scroll chamber 21*c*. Then, the refrigerant gas guided to the outside of the first compression stage 21 is supplied to the second compression stage 22 through an external pipe.

The refrigerant gas supplied to the second compression stage 22 flows into the second impeller 22*a* in the thrust direction through the introduction scroll chamber 22*d*, and is discharged in the radial direction by applying velocity energy thereto by the second impeller 22*a*. The refrigerant gas discharged from the second impeller 22*a* is further compressed by converting velocity energy into pressure energy through the second diffuser 22*b* so that it becomes the compressed refrigerant gas. The compressed refrigerant gas discharged from the second diffuser 22*b* is guided to the outside of the second compression stage 22 through the second scroll chamber 22*c*. As described above, the operation of the turbo compressor 1 is completed.

Next, an air-tightness action of the first seal member 22*i* installed at the first connection portion C1 of the casing structure 40 will be described.

The refrigerant gas introduced into the introduction scroll chamber 22*d* is suppressed from flowing toward the gear unit 30 by the labyrinth seal 23*b* provided in the rotation shaft 23. However, the air-tightness action of the labyrinth seal 23*b* is not complete. Particularly, when the rpm of the rotation shaft 23 is low, the refrigerant gas flows into the accommodation space 33*a* of the gear casing 33. For this reason, the internal pressure of the accommodation space 33*a* is higher than the external pressure of the turbo compressor 1, and the refrigerant gas is apt to flow to the outside through the first connection portion C1 and the second connection portion C2. Furthermore, the positional relationship between the second seal member 13*d* and the third bolt 16 at the second connection portion C2 is generally set, thereby sufficiently preventing the outflow of the refrigerant gas.

On the other hand, the first bolt 35 at the first connection portion C1 is threaded from the accommodation space 33*a*, and the refrigerant gas is apt to flow into the penetration hole formed in the second frame portion 33*b* and allowing the first bolt 35 to be inserted thereinto or flow to the outside through a gap between the first contact surface 22*g* and the second contact surface 33*d*. However, in the embodiment, the first bolt 35 is provided at the inside of the first seal member 22*i* in the radial direction. For this reason, it is possible to prevent the refrigerant gas from flowing to the outside through the penetration hole or the gap between the first contact surface 22*g* and the second contact surface 33*d* by the function of the first seal member 22*i* keeping the air-tightness between the first contact surface 22*g* and the second contact surface 33*d*. Furthermore, the positional relationship between the first seal member 22*i* and the second bolt 36 at the first connection portion C1 is generally set, thereby sufficiently preventing the outflow of the refrigerant gas.

Therefore, according to the embodiment, in the casing structure 40, even when the first bolt 35 connecting the second impeller casing 22*e* and the gear casing 33 to each other is threaded from the accommodation space 33*a* formed by connecting the casings 22*e* and 33 to each other, it is possible to prevent the outflow of the refrigerant gas at the first connection portion C1 of the casings 22*e* and 33.

As mentioned above, although a preferable embodiment according TO the present invention has been described with reference TO the drawings, it is needless TO say that the present invention is not limited TO the related art. Overall shapes, combinations or the like of the respective members shown in the aforementioned examples, and can be variously changed in a scope of not depending from the gist of the present invention based on the design request or the like.

For example, in the above-described embodiment, a case has been described in which the internal pressure of the accommodation space 33*a* is higher than the external pressure, but the invention is not limited thereto. Even when the internal pressure of the accommodation space 33*a* is lower than the external pressure, the first seal member 22*i* and the first bolt 35 are disposed in accordance with the above-described arrangement relationship, it is possible to prevent an external gas from flowing into the accommodation space 33*a* through the first connection portion C1.

Figure 4:
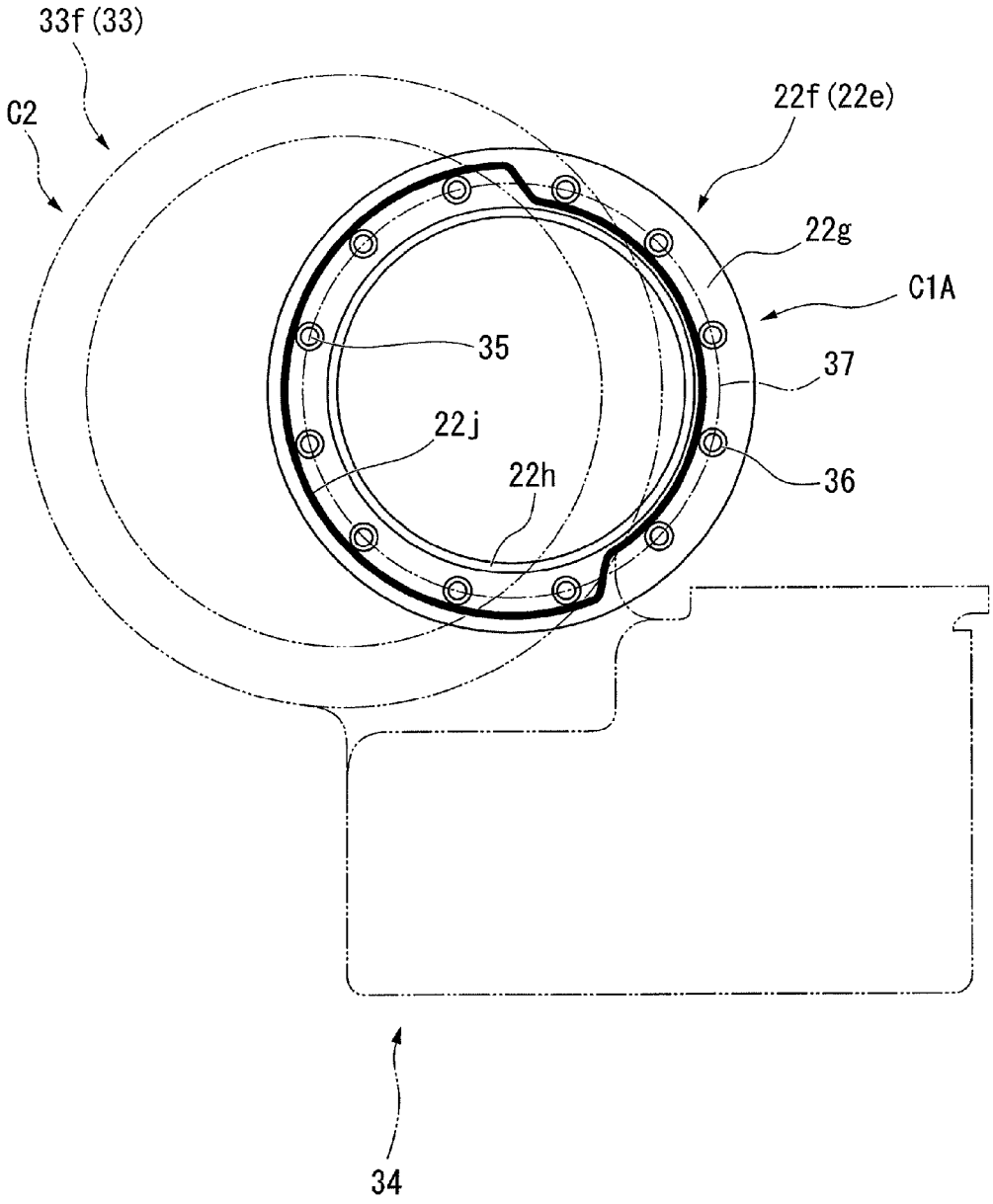
FIG. 4 is a schematic diagram illustrating a modified example of a first connection portion of the embodiment of the invention.

Further, the modified example of the first connection portion C1 shown in FIG. 4 may be applied to the casing structure 40 of the above-described embodiment. FIG. 4 is a schematic diagram illustrating a first connection portion (a connection portion) C1A as a modified example of the first connection portion C1. Furthermore, FIG. 4 is a cross-sectional view taken along the line A-A of FIG. 2 in the casing structure 40 adopting the modified example. In the first connection portion C1A, the first bolt 35 and the second bolt 36 are disposed on one annular path 37. A seal member (a seal member) 22*j* which is formed instead of the first seal member 22*i* and is not formed in an annular shape is formed in a shape in which two circular arcs having different diameters are connected to each other. The seal member 22*j* includes a portion which is provided at the outside of the annular path 37 in the radial direction and provided at the outside of the first bolt 35 and a portion which is provided at the inside of the annular path 37 in the radial direction and provided at the inside of the second bolt 36. Even when the seal member 22*j* not formed in an annular shape is used, it is possible to prevent a gas from flowing into or out from the accommodation space 33*a* through the first connection portion C1A. Further, although the effort of processing the groove portion provided with the seal member 22*j* not formed in an annular shape increases compared to the above-described embodiment, the widths of the first frame portion 22*f* and the second frame portion 33*b* in the radial direction can be made narrower than those of the above-described embodiment.

Further, in the above-described embodiment, the casing structure 40 is used in the turbo compressor 1, but the invention is not limited thereto. For example, a plurality of casings may be connected to each other so that the structure is used as a pipe or a storage tank for a predetermined fluid.

What is claimed is:

1. A casing structure comprising:

an annular seal member positioned at a connection portion between first and second casings, the annular seal member configured to keep air-tightness between an internal space formed by connecting the first and second casings to each other and an outside of the internal space;

a first screw member which is threaded from the internal space, the first screw member positioned at an inside of the annular seal member in the radial direction, and the first screw member is configured to fasten the first and second casings to each other, wherein the first screw member is configured to add fastening force due to fastening thereof to the annular seal member at the connection portion; and a second screw member which is threaded from the outside, the second screw member positioned at an outside of the annular seal member in the radial direction, and the second screw member is configured to fasten the first and second casings to each other, wherein the second screw member is configured to add fastening force due to fastening thereof to the annular seal member at the connection portion, wherein a head of the first screw member engages with one of the first and second casings, such that the first screw member fastens the first and second casings to each other, and the head is positioned in the internal space.

2. The casing structure according to claim 1, further comprising the first and second casings, wherein the first and second casings are provided to surround two predetermined axes, and the two axes are disposed to be eccentric with respect to each other.

3. The casing structure according to claim 1, wherein the seal member is disposed in an annular shape in the connection portion.

4. The casing structure according to claim 2, wherein the seal member is disposed in an annular shape in the connection portion.

5. The casing structure according to claim 1, further comprising a compressor, wherein the compressor comprises the casing structure as recited in claim 1.

6. A casing structure comprising:

a first casing that includes an annular first contact surface;

a second casing that includes an annular second contact surface being in contact with the first contact surface, an accommodation space being formed thereby;

an annular seal member provided between the first and second contact surfaces;

a first screw member threaded through the first and second contact surfaces from the accommodation space and positioned in an inside region of the annular seal member.

7. The casing structure according to claim 6, further comprising:

a second screw member threaded through the first and second contact surfaces from an external area of the casing structure and positioned in an outside region of the annular seal member.

8. The casing structure according to claim 7, wherein the first screw member and the second screw member are positioned on an annular path in the first contact surface.

9. The casing structure according to claim 6, wherein the first contact surface includes a convex portion protruding toward the second contact surface, and the second contact surface includes a concave portion fitted to the convex portion.

10. The casing structure according to claim 7, wherein the first and second screw members are threaded in a same direction.

11. The casing structure according to claim 6, wherein the first casing is an impeller casing and the second casing is a gear casing.

* * * * *